US006991510B2

(12) United States Patent
Nan

(10) Patent No.: US 6,991,510 B2
(45) Date of Patent: Jan. 31, 2006

(54) SWIVEL AIR PASSING JOINT FOR AN INFLATABLE MANNEQUIN

(75) Inventor: Simon Siu Man Nan, Richmond Hill (CA)

(73) Assignee: Nanma Manufacturing Co., Ltd., Chia Wan (HK)

( * ) Notice: Subject to any disclaimer, the term of this patent is extended or adjusted under 35 U.S.C. 154(b) by 331 days.

(21) Appl. No.: 10/657,322

(22) Filed: Sep. 8, 2003

(65) Prior Publication Data

US 2005/0051581 A1 Mar. 10, 2005

(51) Int. Cl.
*A63H 3/06* (2006.01)

(52) U.S. Cl. ..... 446/220

(58) Field of Classification Search ..... 446/220, 446/221, 223, 226, 376, 384; 472/134
See application file for complete search history.

(56) References Cited

U.S. PATENT DOCUMENTS

| | | | | |
|---|---|---|---|---|
| 703,899 | A | 7/1902 | Debes | |
| 1,968,492 | A | 7/1934 | Kallus | |
| 2,118,682 | A | 2/1938 | Nagel | |
| 2,503,948 | A | 4/1950 | Henry | |
| 2,731,768 | A | 1/1956 | Harrowe | |
| 3,065,566 | A | 11/1962 | Sugimoto | |
| 4,055,020 | A | 10/1977 | Kosicki et al. | |
| 4,895,546 | A | 1/1990 | Rakonjac | |
| 4,968,282 | A | 11/1990 | Robson et al. | |
| 5,516,322 | A | 5/1996 | Myers | |
| 6,494,763 | B1 | 12/2002 | Hastey | |
| 6,805,606 | B1 * | 10/2004 | Kellum | 446/176 |
| 2002/0111109 | A1 | 8/2002 | Kwan | |

* cited by examiner

*Primary Examiner*—Kien Nguyen

(57) ABSTRACT

The present invention relates to a swivel air-passing joint mechanism for connecting the limbs to the torso of an inflatable mannequin. The swivel air-passing joint comprises a ball and socket joint arrangement with a flexible tubular passageway element traversing through the ball and socket joint that provides a constant passageway for fluid communication between the limbs and the torso irrespective of the particular limb orientation to the torso.

25 Claims, 5 Drawing Sheets

SWIVEL AIR PASSING JOINT FOR AN INFLATABLE MANNEQUIN

BACKGROUND OF THE INVENTION

1. Field of the Invention

The present invention relates to a joint mechanism for use in an inflatable mannequin, and more particularly to a swivel air passing joint mechanism that allows full omni-directional articulation of the doll's limb members while permitting air to freely pass through the joint mechanism.

2. Prior Art

Inflatable dolls, mannequins, and other air filled toys that are designed to resemble actual human beings are well known in the art. Often it is desirable that inflatable dolls and mannequins be life like and resemble actual human anatomy and limb articulation. It is also desirable that the inflation of the dolls and mannequins be accomplished quickly and efficiently through a single air inlet located along the torso section of the doll for allowing simultaneous inflation of the entire doll including the limb members. However, current inflatable dolls and mannequins that are inflatable from a single air inlet valve are not capable of resembling and mimicking actual human anatomy and limb articulation. The main cause of this problem relates to the prior art joint mechanisms that attach the limb members to the doll's torso.

In order to allow for full omni-directional articulation of the limbs the inflatable mannequin must include a ball and socket type joint connecting the limb to the torso of the doll. However, while a conventional ball and socket joint allows for full omni-directional articulation it does not allow for air to freely pass between the limb members and the torso. This occurs because the prior art ball and socket joint is a solid structural element which prevents the flow of air from the torso to the limbs. Since air cannot flow from the torso to the limbs dolls, prior art ball and socket joints must include an air inlet on the torso of the doll and separate air inlets on each of the respective limb members which increases the amount of time needed to inflate and deflate the doll.

Prior art inflatable mannequins have also been proposed that allow for both movement of the limb members relative to the torso and allow air to freely flow between the torso and limb members. These dolls have limb members with limited limb articulation that feature ball and socket joints which allow for air to pass through them. However, these dolls utilize ball and socket joints that must be aligned in a specific manner for air or fluid to flow through the ball and socket joint between the torso and each individual limb member.

For example, U.S. Pat. No. 5,516,322 to Myers discloses a liquid filled doll comprising a single reservoir having fluid flow communication between the doll's torso, arms, and legs. One of the connecting elements for the limbs features a ball and socket joint having a passageway for liquid to pass through the ball and socket joint. However, the Myers reference requires that liquid flow through two opposing holes placed within the ball and socket joint that must be properly aligned. In fact, the two opposing holes must be properly aligned in registry with one another in order for liquid to flow through the ball and socket joint. However, when the limb members of Myers are articulated in an omni-directional manner the opposing holes are placed out of registry, therefore liquid is not able to flow through the ball and socket joint of Myers which seriously hinders the effectiveness of the flow and limits the articulation of the limb members relative to the torso.

Additionally, U.S. Pat. No. 2,731,768 to Harrowe discloses an inflatable mannequin that allows air to freely pass between the torso and the limbs of the doll. The Harrowe patent utilizes a cylindrical tube member that acts as a passageway for air to travel between the limbs and torso of the doll. The reference also discloses a connector element having a hollow sleeve member that defines serrated grooves adapted to be secured to internal grooves formed along the torso and limb, respectively. However, the cylindrical tube disclosed in the Harrowe patent is rigid and therefore cannot be adapted to accommodate a ball and socket joint. Since the device disclosed by Harrowe is incapable of including a ball and socket joint the limbs of the doll are only capable of forward and backward motion. Accordingly, the limb members of the Harrowe doll are not capable of full omni-directional articulation, and thus the reference does not satisfy the need in the art for a mannequin that is able to closely duplicate actual human limb movement while permitting air to freely pass between the limb members and torso at all limb articulations.

Therefore, there appears a need in the art for a swivel air passing joint mechanism for use with an inflatable mannequin that includes a ball and socket joint arrangement having a flexible tubular air passageway element that provides full omni-directional articulation of limb members, while permitting air to freely pass between the torso and limb members regardless of the particular articulation of the limb members.

OBJECTS AND SUMMARY OF THE INVENTIONS

Accordingly, the primary object of the present invention is to provide a swivel air passing joint for use in an inflatable mannequin that is capable of omni-directional limb movement while acting as a conduit for allowing air to freely pass through the joint at any limb articulation.

Another object of the present invention is to provide a ball and socket joint arrangement with a hollow, flexible tubular air passageway element traversing through the entire ball and socket joint arrangement while allowing the joint arrangement to have a normal articulating function.

A further object of the present invention is to provide an inflatable mannequin with swivel air passing joint mechanisms connecting the limb members to the torso in order to allow for both omni-directional movement of the limbs while permitting air to flow through the joint mechanism regardless of the limb's orientation relative to the torso.

Yet another object of the present invention is to provide a ball and socket joint arrangement with a flexible, hollow tubular element traversing through the ball and socket joint arrangement that is capable of permitting air flow through the tubular element irrespective of the position of the ball and socket joint arrangement.

These and other objects of the present invention are realized in the preferred embodiment of the present invention, described by way of example, and not by way of limitation, which provides for a swivel air passing joint mechanism for use with an inflatable mannequin which allows for omni-directional articulation of limb members and further includes a hollow flexible tubular air passageway element for permitting air to freely pass between the torso and limb members during inflation regardless of the particular articulation of the limb member.

In brief summary, the present invention overcomes and substantially alleviates the deficiencies in the prior art by providing a swivel air passing joint mechanism including a cup member engageable with a ball member and socket member to form a ball and socket joint arrangement having a conduit formed therethrough. A tubular air passageway element traverses through the conduit of the ball and socket joint arrangement which is connectable between the torso and each respective leg and arm member. The flexible tubular air passageway element allows air to pass between the torso and any one of the limb members regardless of the limb member's orientation because of the flexible nature of the tubular air passageway element ensures continuous fluid flow communication between all portions of the doll body.

This combination of a tubular air passageway element and a ball and socket joint arrangement is advantageous as it allows air to pass from the torso directly through the ball and socket joint arrangement while allowing full omni-directional articulation of the limb members. Furthermore, air can continue to freely pass through the swivel air passing joint mechanism no matter what position the limb member is articulated relative to the torso of the mannequin body. Another advantage of the present invention is that the entire mannequin's body can be inflated through one single air inlet valve. The single air inlet valve allows for fast and efficient inflation of the mannequin because both the torso and limb members can be inflated through a single inlet in fluid flow communication with the tubular air passageway element of each respective ball and joint arrangement. This permits inflation of the arm and leg members without having to separately inflate each respective member.

Additional objects, advantages and novel features of the invention will be set forth in the description that follows, and will become apparent to those skilled in the art upon examination of the following more detail description and drawings in which like elements of the invention are similarly numbered throughout.

DETAILED DESCRIPTION OF THE INVENTION

Figure 1:
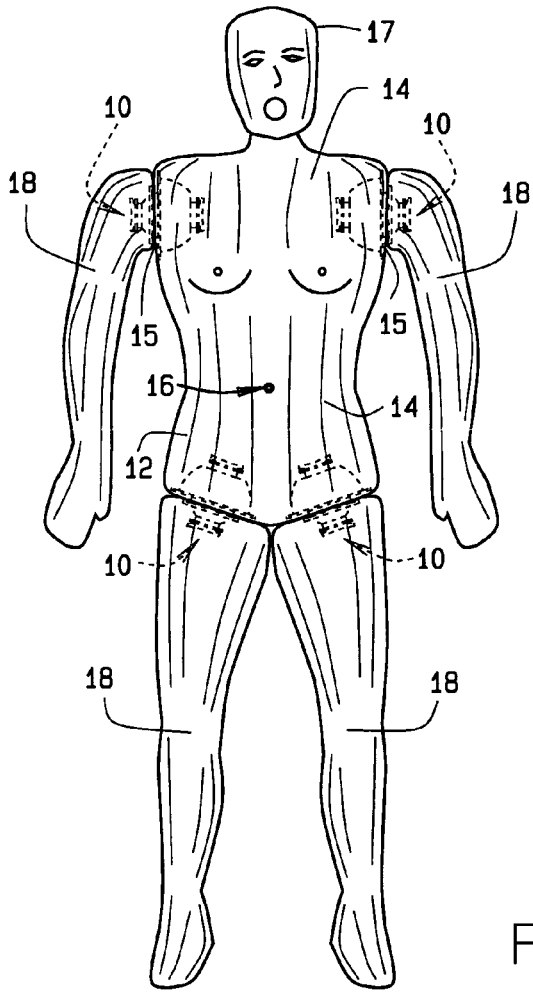
FIG. 1 is a perspective view of the inflatable mannequin depicting the locations of the swivel air passing joint mechanisms according to the present invention.

Referring to the drawings, the preferred embodiment of the swivel air-passing joint mechanism for an inflatable mannequin is illustrated and generally indicated as 10 in FIGS. 1–11. Swivel air-passing joint mechanism 10 allows an inflatable mannequin 12 to have limb members 18 with full omni-directional movement while providing a flexible air passageway between the limb members 18 and the body of the inflatable mannequin 12.

Figure 2:
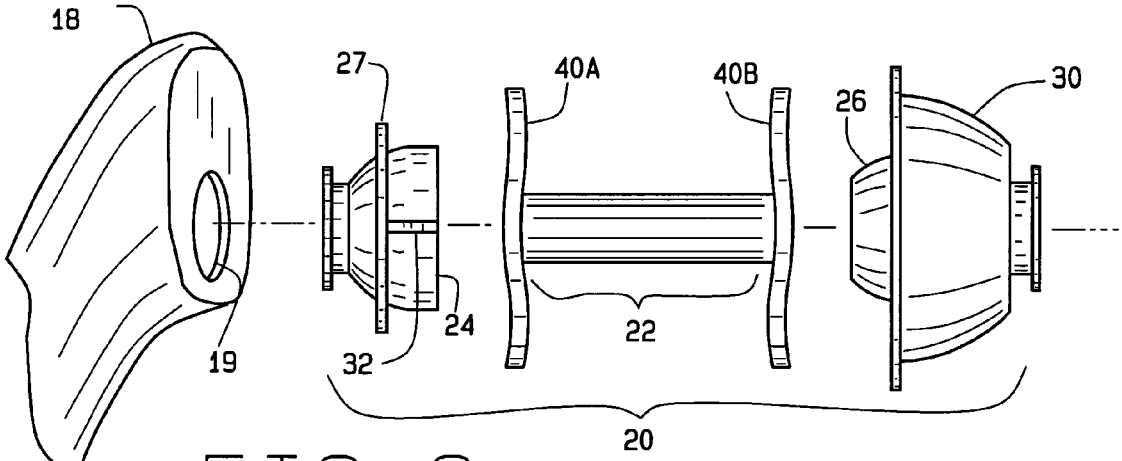
FIG. 2 is an exploded view of the tubular air passageway element and the swivel air passing joint mechanism according to the present invention.
Figure 9:
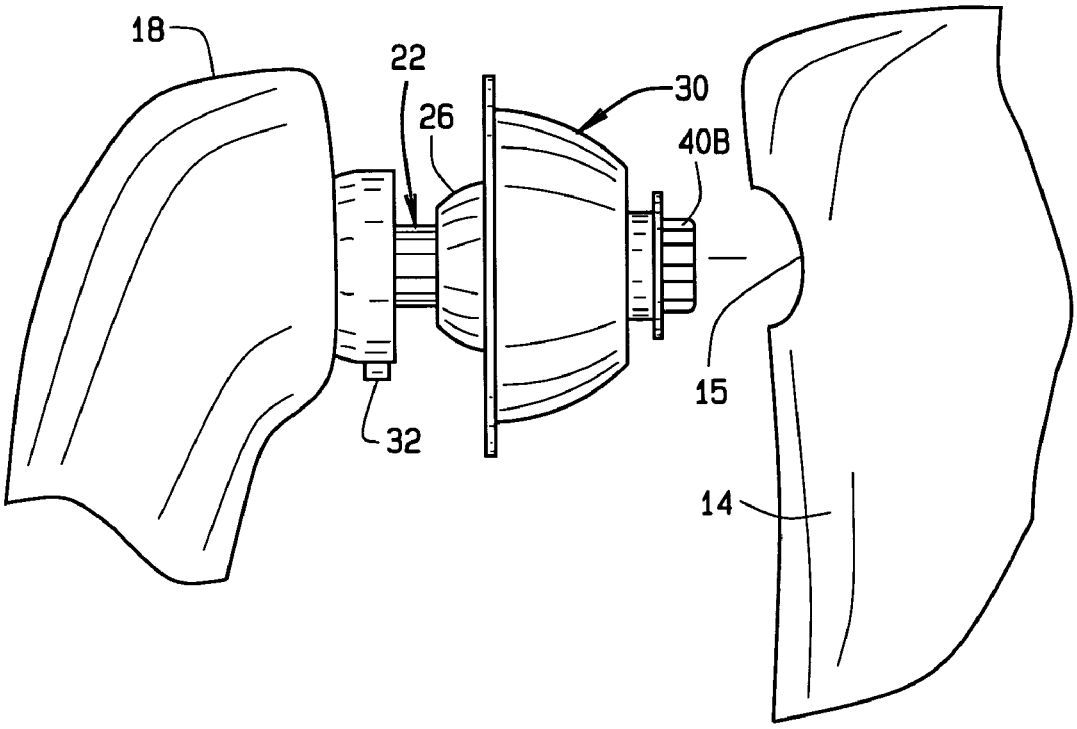
FIG. 9 is a perspective view of the limb member with the socket member and tubular air passageway element attached thereto during assembly of the swivel air passing joint mechanism according to the present invention.
Figure 10:
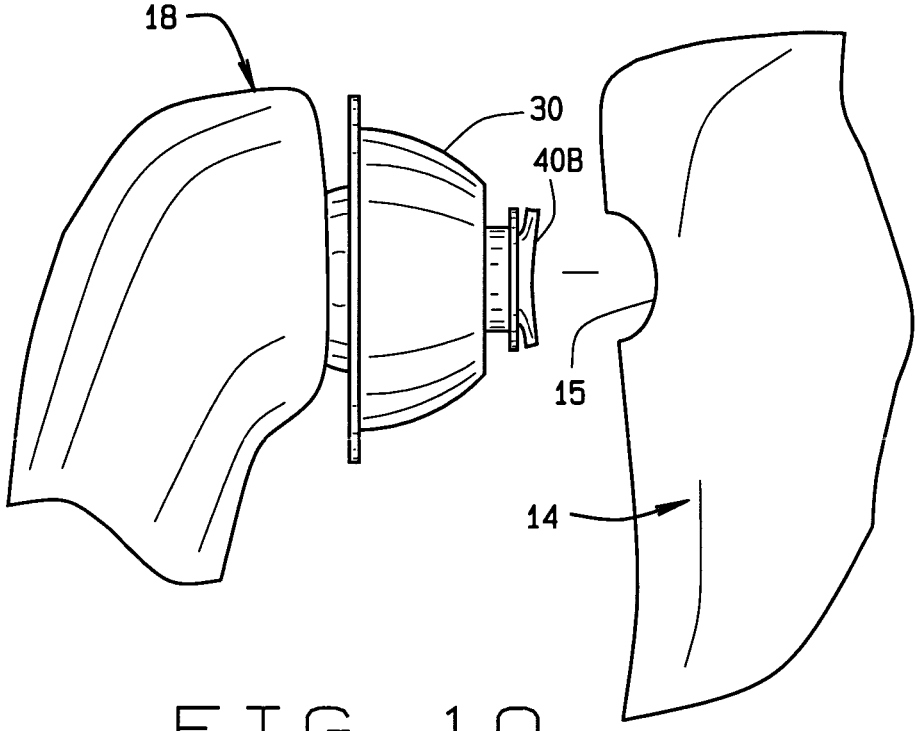
FIG. 10 is a perspective view depicting the swivel air passing joint mechanism fully assembled and inserted into a limb member but not yet inserted into the torso of an inflatable mannequin during assembly of an inflatable mannequin according to the present invention.
Figure 11:
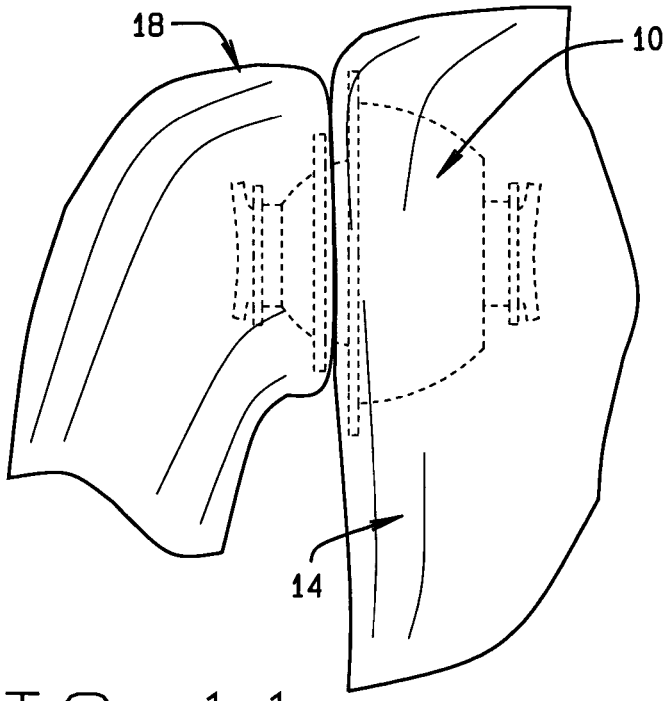
FIG. 11 is a side view depicting the swivel air passing joint mechanism shown in phantom fully assembled and which connects the limb to the torso of an inflatable mannequin according to the present invention.

Referring to FIGS. 1–2, and 9 inflatable mannequin 12 includes a torso 14 forming the body of inflatable mannequin 12 with an air inlet 16 to allow air to enter and exit when inflatable mannequin 12 is being inflated or deflated. Torso 14 is engaged to a head member 17 and respective limb members 18 to give inflatable mannequin 12 a realistic, life-like appearance. As further shown, each limb member 18 is designed to resemble human limbs and include an aperture 19 for engaging one end of swivel air passing joint mechanism 10 which enables limb members 18 to be attached to torso 14. Limb members 18 are attached to torso 14 by a swivel air-passing joint mechanism 10 that is engaged to apertures 15 formed along respective sites along torso 14 corresponding to where the appropriate limb member 18 should be attached.

As depicted in FIG. 2, swivel air-passing joint mechanism 10 allows limb members 18 to have full omni-directional movement simulating the life-like articulation of human arms and legs. Swivel air-passing joint mechanism 10 comprises a ball and socket joint arrangement 20 and a tubular air passageway element 22 traversing through the ball and socket joint arrangement 20 in order to provide a means for unrestricted air flow between the torso 14 and limb members 18 regardless of the particular articulation of members 18.

Figure 3:
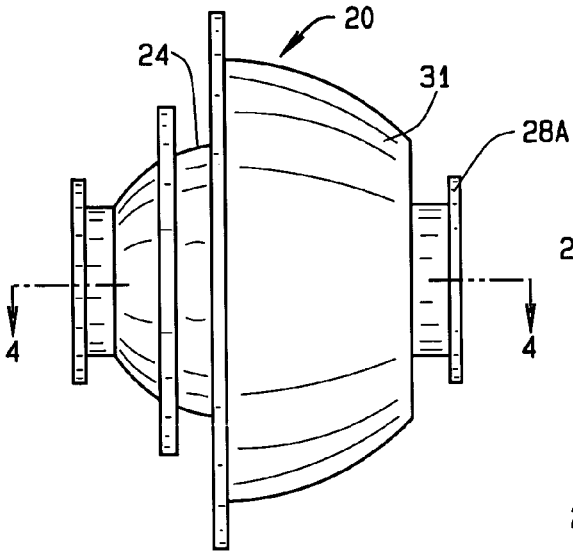
FIG. 3 is a side view of the fully assembled swivel air passing joint mechanism according to the present invention.
Figure 4:
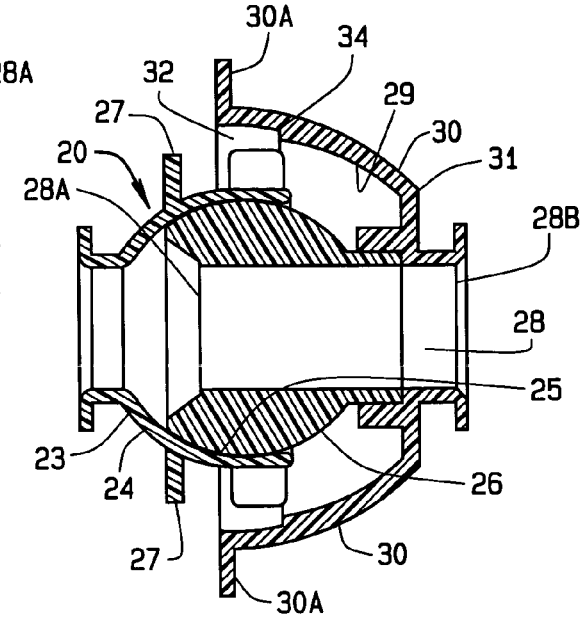
FIG. 4 is a cross sectional view of the swivel air passing joint mechanism taken along line 4—4 of FIG. 3 according to the present invention.
Figure 5:
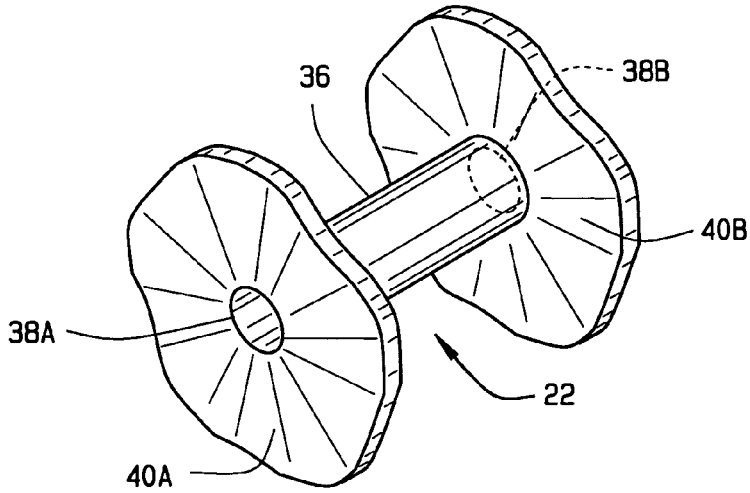
FIG. 5 is a perspective view of the tubular air passageway element according to the present invention.

Referring to FIGS. 3–5, ball and socket joint arrangement 20 comprises a ball member 26 rotatably received within a socket member 24 having a cup member 30 interconnecting ball member 26 to socket member 24. Socket member 24 is cup shaped element with a rear side 23 and a front side 25. As further shown, front side 25 is in direct contact with ball member 26 and shaped to receive ball member 26 in the preferred embodiment of the invention. Socket member 24 also includes a lip 27 to secure socket member 24 to limb member 18 during assembly, as shall be explained in greater detail below, which is located along rear side 23 of socket member 24 and surrounds the entire radius of the socket member 24.

In assembly, ball member 26 has a spherical body that is sized and shaped to be rotatably received inside socket member 24. Ball and socket joint arrangement 20 further includes a conduit 28 that is formed through ball member 26 to provide access for tubular air passageway element 22 to pass through the entire ball and socket joint arrangement 20 during assembly. Conduit 28 includes an opening 28A which is located immediately adjacent front side 25 of socket member 26 when the swivel air passing joint mechanism 10 is assembled and an opening 28B which is located on the opposite side of ball member 26 adjacent to cup member 30. To complete the assembly of the ball and socket joint arrangement 20, cup member 30 is securely interconnected the socket members 24 to ball member 26.

As further shown, cup member 30 comprises a bottom side 29 and a top side 31 with a raised edge 30A enabling cup member 30 to surround and conceal ball member 26 when engaged thereto. At least one or more tabs 32 are located on socket member 24 with a corresponding set of recesses 34 on the top side 31 of cup member 30 which lock ball member 26 to socket member 24 during assembly as shall be explained in greater detail below. Once tabs 32 are placed within recesses 34 during assembly, ball member 26 is securely mounted within socket member 24 and permits limb members 18 to have full omni-directional movement when attached to torso 14.

As noted above, tubular air passageway element 22 allows for air to freely pass through ball and socket joint arrangement 20 irrespective of the orientation of limb member 18 relative to torso 14. Referring to FIG. 5, tubular air passageway element 22 includes a flexible tube 36 which forms a conduit for air to pass through ball and socket joint arrangement 20 with first and second openings 38A and 38B formed on opposing ends of flexible tube 36. Two sheath members 40A and 40B are also attached to flexible tube 36 adjacent openings 38A and 38B, respectively, which secure flexible tubular air passageway element 22 to ball and socket joint arrangement 20.

Figure 6:
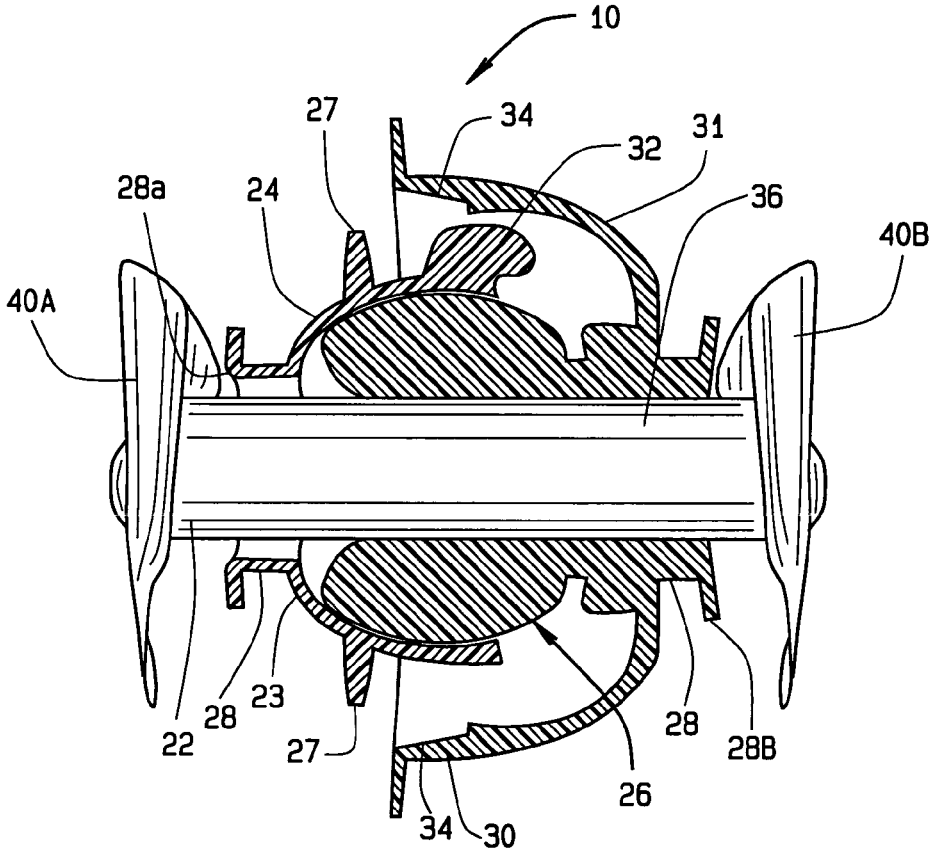
FIG. 6 is partial cross sectional view of the swivel air passing joint mechanism with the tubular air passageway element traversing through the swivel air passing joint mechanism according to the present invention.

FIG. 6 depicts flexible tubular air passageway element 22 traversing though ball and socket joint arrangement 20 which forms the swivel air passing joint mechanism 10 of the present invention. When fully assembled, flexible tube 36 is disposed within conduit 28, ball member 26 is surrounded by and attached to cup member 30 and disposed within socket member 24, thereby securing socket member 24 by the interlocking of tabs 32 to recesses 34. Sheath 40B of tubular air passageway member 22 extends outwardly from conduit 28 from opening 28B and covers top portion 31 of cup member 30 located within torso 14. Finally, sheath 40A extends outwardly from opening 28A and covers the rear side 23 of socket member 24.

FIGS. 7–11 depict the assembly of swivel air-passing joint mechanism 10 which illustrates the steps for connecting limb member 18 to torso 14. In the preferred embodiment of the present invention, inflatable mannequin 12 has a swivel air passing joint mechanism 10 for each respective limb member 18. Each assembly is identical and for simplicity only one assembly of swivel air-passing joint mechanism 10 for one respective limb member 18 will be explained herein.

To assemble, first opening 38A of flexible tubular air passageway element 22 is inserted and pulled through socket 24 to allow sheath 40A to cover the rear side 23 of socket member 24. In the preferred embodiment, flexible tube 36 of tubular air passageway element 22 will be pulled taut so that sheath 40A will tightly cover rear side 23 of socket member 24 providing both an air tight seal and strength to swivel air-passing joint mechanism 10. Preferably, sheath 40A is secured to the rear side 23 of socket member 24 by a high frequency welding process or other well known securing methods.

Socket member 24 with flexible tubular air passageway element 22 attached thereto is then inserted into aperture 19 of limb member 18. The lip 27 of socket member 24 has a larger diameter than aperture 19 which secures socket 24 to limb member 18 after being forced through aperture 19 during assembly. Aperture 19 of limb member 18 as well as aperture 15 located along torso 14 are malleable during this step in the assembly process due to its deflated state; thereby, allowing larger lip member 27 to be forced through the smaller aperture 19. After mannequin 12 is inflated, aperture 19 becomes rigid and lip member 27 cannot be withdrawn through aperture 19 which provides a secure fit between limb member 18 and torso 14.

Figure 7:
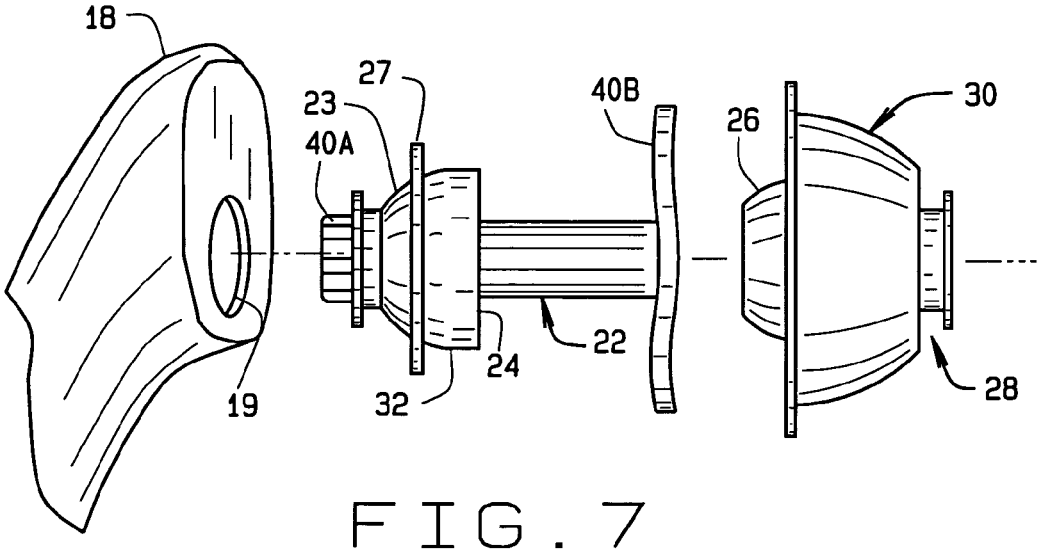
FIG. 7 is a perspective view depicting the limb and the socket member of the swivel air passing joint mechanism during assembly with the tubular air passageway element being inserted through the socket member but not yet inserted through the ball member according to the present invention.

After socket member 24 is engaged to limb member 18, opening 38B of tubular air passageway element 22 is attached to ball member 26 which is then secured to socket member 24. As depicted in FIG. 7, at this stage in the assembly process, ball member 26 is attached to cup member 30 by known means in the art. Opening 38B of tubular air passageway element 22 is then inserted and pulled through and out from conduit 28 at opening 28A in order to allow sheath 40B to properly cover top side 31 of cup member 30. A high frequency welding process is then used to securely attach sheath 40B to top side 31.

Figure 8:
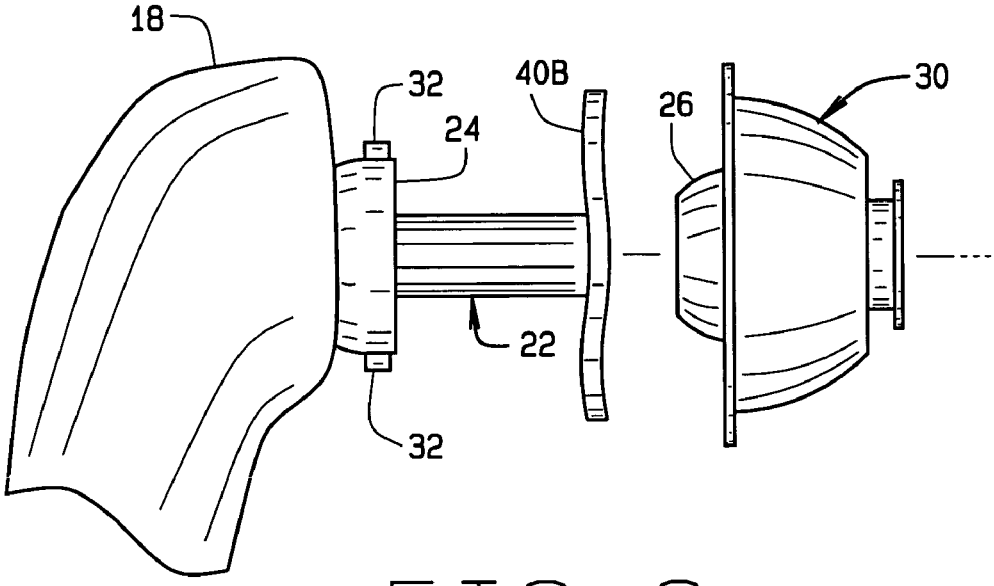
FIG. 8 is a perspective view depicting the limb and the socket member of the swivel air passing joint mechanism during assembly with the tubular air passageway element completely inserted though the socket member but not yet inserted through the ball member according to the present invention.

Referring now to FIGS. 8–9, tubular air passageway element 22 traverses through both the socket member 24 and ball member 26. At this stage in the assembly process, the ball and socket joint arrangement 20 must be assembled to complete swivel air-passing joint mechanism 10 which connects limb member 18 to torso 14. Ball member 26 is placed within socket member 24 and tabs 32 located on socket member 24 are aligned with recesses 34 on cup member 30 and locked together. Limb member 18 is now securely attached to torso 14 and an air tight seal is formed therebetween. In the preferred embodiment, this process would be repeated until all of limb members 18 were properly attached to torso 14 of inflatable mannequin 12 in accordance with the present invention.

Inflatable mannequin 12 is now ready for inflation. Once inflated, the limb members 18 attached to torso 14 by swivel air passing joint mechanism 10 are capable of full omni-directional articulation similar to actual human movement. Further, air is able to flow freely between torso 14 to limb members 18 through the swivel air-passing joint mechanism 10 irrespective of the limb member's 18 orientation relative to torso 14. This allows inflatable mannequin 12 to be quickly and easily inflated through a single air inlet 16 located on torso 14.

It should be understood from the foregoing that, while particular embodiments of the invention have been illustrated and described, various modifications can be made thereto without departing from the spirit and scope of the invention. Therefore, it is not intended that the invention be limited by the specification; instead, the scope of the present invention is intended to be limited only by the appended claims.

What is claimed is:

1. An inflatable mannequin comprising:

a) a torso with at least one articulating limb member attached to said torso; and b) a swivel air-passing joint mechanism for attaching said at least one articulating limb member to said torso comprising a ball and socket joint arrangement with a tubular air passageway element traversing through said ball and socket joint arrangement that allows fluid flow communication between said at least one articulating limb member and said torso while permitting omni-directional articulation of said at least one articulating limb member relative to said torso.

2. The inflatable mannequin of claim 1 wherein said tubular air passageway element further includes at least two sheath members attached to opposing ends of said tubular air passageway element.

3. The inflatable mannequin of claim 2 wherein said at least two sheath members are attached to said ball and socket joint arrangement to securely attach said tubular air passageway element to said ball and socket joint arrangement.

4. The inflatable mannequin of claim 1 further including a single air inlet valve for inflating and deflating said inflatable mannequin.

5. The inflatable mannequin of claim 1 wherein said tubular air passageway element forms a passageway through said swivel air-passing joint mechanism for providing fluid flow communication between said torso and said at least one articulating limb member.

6. The inflatable mannequin of claim 1 wherein said ball and socket joint arrangement comprises:

a) a ball member, b) a socket member shaped to rotatably receive said ball member, c) a conduit which traverses through said ball member, and d) a cup member which surrounds said ball member and attaches said ball member to said socket member.

7. The inflatable mannequin of claim 6 wherein said tubular air passageway element comprises:

a) a hollow, flexible tubular element with two opposing ends disposed within said conduit, b) a sheath member attached to one of said two opposing ends of said hollow, flexible tubular element that is further attached to said socket member, and c) a sheath member attached to the other end of said two opposing ends of said hollow, flexible conduit that is further attached to said cup member.

8. The inflatable mannequin of claim 7 wherein said ball and socket arrangement further includes lip members attached to said socket member and to said cup member for securing said ball and socket arrangement to said inflatable mannequin.

9. A swivel air-passing joint mechanism for use with a hollow mannequin comprising:

a) a socket member defining an aperture;

b) a ball member rotatably received within said socket member capable of omni-directional articulation within said socket member, said ball member defining a conduit with openings formed at the opposite ends of said conduit; and c) a tubular air passageway element disposed within said conduit and extending outwardly from said aperture that allows fluid communication through said ball member and said socket member irrespective of the registry of said two openings relative to said aperture.

10. The swivel air-passing joint mechanism of claim 9 further including a lip member attached to said socket member for securing said socket member to a limb member of an inflatable mannequin.

11. The swivel air-passing joint mechanism of claim 9 further comprising a cup member which defines an aperture placed over and attached to said ball member which interconnects said ball member to said socket member.

12. The swivel air-passing joint mechanism of claim 11 wherein said cup member further includes a lip member to secure said cup member to a torso on an inflatable mannequin.

13. The swivel air-passing joint mechanism of claim 9 wherein said tubular air passageway element further includes two sheath members attached at opposing ends of said tubular air passageway element to securely attach said tubular air passageway element to said swivel air-passing joint mechanism.

14. The swivel air-passing joint mechanism of claim 13 wherein one of said two sheath members is affixed to said cup member while the other of said two said sheath members is affixed to said socket member.

15. A hollow mannequin comprising;

a) a hollow torso; and b) at least one fully articulating hollow limb member capable of omni-directional articulation, said at least one fully articulating hollow limb member being attached to said hollow torso and in constant fluid flow communication with said hollow torso regardless of the particular omni-directional articulation relative to said hollow torso.

16. The hollow mannequin of claim 15 wherein said at least one fully articulating hollow limb member capable of omni-directional articulation is attached to said hollow torso with a swivel air-passing joint mechanism.

17. The hollow mannequin of claim 16 wherein said swivel air passing joint mechanism comprises a ball and socket joint arrangement with a hollow flexible tubular element traversing through said ball and socket joint arrangement.

18. The hollow mannequin of claim 17 wherein said ball and socket arrangement comprises:

a) a ball member with a conduit traversing through said ball member, and b) a socket member rotatably receiving said ball member.

19. The hollow mannequin of claim 18 further comprising a tubular air passageway element which is placed within said conduit and attached to said ball and socket arrangement.

20. The hollow mannequin of claim 15 wherein there are four of said hollow articulating limb members.

21. The hollow mannequin of claim 20 wherein said four hollow articulating limb members are arm members and leg members.

22. The hollow mannequin of claim 15 wherein said hollow mannequin is inflatable.

23. The hollow mannequin of claim 15 further including a single inlet valve for allowing air or fluid to enter and exit said hollow mannequin.

24. A method of allowing constant fluid flow communication between two hollow bodies attached to one another comprising the steps of:

a) providing at least two hollow bodies with an opening located on each of said at least two hollow bodies;

b) providing a swivel air-passing joint mechanism to attach said at least two hollow bodies to one another comprising;

i) a ball and socket joint arrangement with a front end and a back end, ii) a tubular air passageway element traversing through said ball and socket joint arrangement allowing fluid flow communication through said ball and socket joint arrangement while permitting said ball and socket joint arrangement to have full omni-directional movement; and c) connecting said at least two bodies together by attaching said front end of said ball and socket joint to one opening of one body and connecting the back end of said ball and socket joint to the opening of the other of said at least two hollow bodies.

25. The method of allowing fluid flow communication between two hollow bodies of claim 24 further comprising the step of placing fluid within one body by means of a single inlet valve and allowing said fluid to freely flow between said at least two hollow bodies.

* * * * *

UNITED STATES PATENT AND TRADEMARK OFFICE

CERTIFICATE OF CORRECTION

PATENT NO. : 6,991,510 B2
DATED : January 31, 2006
INVENTOR(S) : Simon Siu Man Nan It is certified that error appears in the above-identified patent and that said Letters Patent is hereby corrected as shown below:

Title page,
Item [73], Assignee, should read -- Nanma Manufacturing Co., Ltd., Chai Wan --.

Signed and Sealed this

Fourth Day of April, 2006

JON W. DUDAS
*Director of the United States Patent and Trademark Office*